US008470751B2

(12) United States Patent
Bell et al.

(10) Patent No.: US 8,470,751 B2
(45) Date of Patent: Jun. 25, 2013

(54) LUBRICATING OIL COMPOSITIONS

(75) Inventors: Ian A. W. Bell, Abingdon (GB); Robert W. Shaw, Abingdon (GB)

(73) Assignee: Infineum International Limited (GB)

( * ) Notice: Subject to any disclaimer, the term of this patent is extended or adjusted under 35 U.S.C. 154(b) by 1471 days.

(21) Appl. No.: 11/436,778

(22) Filed: May 18, 2006

(65) Prior Publication Data

US 2006/0281645 A1 Dec. 14, 2006

(30) Foreign Application Priority Data

May 20, 2005 (EP) ..... 05253123

(51) Int. Cl.
*C10M 159/20* (2006.01)

(52) U.S. Cl.
USPC ..... 508/460

(58) Field of Classification Search
USPC ..... 508/460
See application file for complete search history.

(56) References Cited

U.S. PATENT DOCUMENTS

| | | | | |
|---|---|---|---|---|
| 5,658,862 | A * | 8/1997 | Vrahopoulou | 508/192 |
| 5,906,969 | A * | 5/1999 | Fyfe | 508/364 |
| 2005/0170978 | A1 * | 8/2005 | Migdal et al. | 508/497 |

FOREIGN PATENT DOCUMENTS

| | | | |
|---|---|---|---|
| EP | 0 953 629 | A1 | 11/1999 |
| EP | 1 310 549 | A1 | 5/2003 |
| EP | 1 329496 | A1 | 7/2003 |

* cited by examiner

*Primary Examiner* — Jim Goloboy

(57) ABSTRACT

An internal combustion engine crankcase lubricating oil composition has a phosphorus content of not greater than 0.08 mass % and a metal detergent additive system comprising a calcium salicylate and a magnesium salicylate and having a mass ratio of magnesium atoms to calcium atoms of greater than one.

5 Claims, No Drawings

LUBRICATING OIL COMPOSITIONS

This invention relates to internal combustion engine crankcase lubricating oil compositions (or lubricants), more especially to composition suitable for use in piston engine, especially gasoline (spark-ignited) and diesel (compression-ignited), lubrication; and to use of additives in such compositions for reducing wear.

A crankcase lubricant is an oil used for general lubrication in an internal combustion engine where an oil sump is situated generally below the crankshaft of the engine and to which circulated oil returns. It is well-known to include additives in crankcase lubricants for several purposes.

There has been a need and/or requirement to reduce the level of phosphorus in crankcase lubricants in order to improve the durability of exhaust gas treatment catalysts. Reduction in phosphorus levels can, however, cause increased wear in the engine.

It is also known to provide salicylate-based metal detergents as additives in crankcase lubricants because they may provide better detergency than phenate-based and sulfonate-based detergents.

EP-A-1 338 643 ('643) describes crankcase lubricants that contain overbased calcium or magnesium salicylate and that have less than 50 ppm of phosphorus. '643 describes tests on an example of such a lubricant, containing calcium salicylate and having no phosphorus, to measure the average cam wear, which is reported to be within ILSAC GF-3 engine test limits.

A problem in the disclosure of '643 is that it concerns itself with cam wear alone, not with cam and lifter wear combined, in low phosphorus-content crankcase lubricants that contain a salicylate-based detergent system. Cam-plus-lifter wear is one of the parameters of the sequence IIIG test, which is an API Category SM, ILSAC Category GF-4 test carried out during high temperature conditions and which simulates high-speed service during relatively high ambient temperature conditions.

Such wear is found to be unsatisfactory when using lubricants that contain calcium salicylate detergents such as described in '643. The present invention, surprisingly, and as evidenced by the data presented in this specification, overcomes the problem by employing a combination of magnesium salicylate and calcium salicylate.

WO 96/37582 A describes use of such combinations but describes them only for providing friction-reducing properties. Moreover, the present invention provides the magnesium salicylate and calcium salicylate in a defined ratio, in lubricants containing no greater than 0.08 mass % of phosphorus.

EP 953629A claims and describes a lubricating oil composition for internal combustion engines which has a high temperature high shear viscosity according to ASTM D 4684 in the range of from 2.1 to less than 2.9 mPas, which composition comprises lubricating base oil and: (1) zinc dialkyldithiophosphate so that the phosphorus content in the oil is from 0.04 to 0.12 mass %, where the relationship between the primary and secondary alcohol in the zinc dialkyldithiophosphate alcohol residue satisfies the following expression in terms of the amount (mass %) of elemental phosphorus in the oil: $0.04<(Pri)+(Sec)<0.12$, and $0<(Pri)<0.03$, where (Pri) is the mass % of primary alcohol residue and (Sec) is the mass % of secondary alcohol residue, and: (2) metallic detergent chosen from (i) calcium alkylsalicylate and (ii) a mixture of calcium alkylsalicylate and magnesium alkylsalicylate so that the lubricating oil sulphated ash content is from 0.8 to 1.8 mass %, according to JIS K2272, and optionally (3) at most 2.0 mass % of friction modifier. The lubricating oil composition is intended to provide good antiwear properties with respect to moving valve parts in four stroke engines. This document teaches that when a mixture of calcium alkylsalicylate and magnesium alkysalicylate is used, the amount of metallic magnesium content in the lubricating oil should not exceed the amount of metallic calcium in the oil.

EP 1310549A claims and discloses a crankcase lubricating oil composition comprising, or made by admixing, an oil of lubricating viscosity in a major amount, and, in respective amounts, a boron-containing additive and one or more co-additives, wherein the lubricating oil composition has greater than 200 ppm by mass of boron, less than 600 ppm by mass of phosphorus and less than 4000 ppm by mass of sulfur, based on the mass of the oil composition. The oil composition may comprise salicylate detergents and where calcium salicylate and magnesium salicylate are used, the calcium salicylate should be present in a greater amount than the magnesium salicylate, based on the mass of the respective metals.

EP 1329496A describes and claims a crankcase lubricating oil composition comprising, or made by admixing, an oil of lubricating viscosity in a major amount, and, in respective minor amounts, a boron-containing additive and one or more co-additives, wherein the lubricating oil composition has greater than 200 ppm by mass of boron, less than 900 ppm by mass of phosphorus and less than 6000 ppm by mass of sulfur, based on the mass of the oil composition. The oil composition may comprise salicylate detergents such as calcium salicylate and magnesium salicylate. This document teaches that the amount of calcium in the oil composition from calcium salicylate should be greater than the amount of magnesium in the oil composition from magnesium salicylate.

In one aspect, the present invention provides a lubricating oil composition as defined in claim 1 of the set of claims following the present description of the invention. Preferred and optional features of the lubricating oil composition are defined in the other claims of the said set of claims.

In a first aspect, the invention provides an internal combustion engine crankcase lubricating oil composition having a phosphorus concentration, expressed as atoms of phosphorus, of not greater than 0.08 mass %, based on the mass of the oil composition, which composition comprises or is made by admixing: (A) an oil of lubricating viscosity, in a major amount; and (B) a metal detergent system, as an additive in a minor amount, comprising a calcium salicylate and a magnesium salicylate and having a mass ratio of magnesium atoms to calcium atoms of greater than one, such as 5:4 or greater, preferably up to 10:1.

In a second aspect, the invention provides a method of lubricating a compression-ignited or spark ignited internal combustion engine, which method comprises supplying to the engine a lubricating oil composition according to one or more of the claims of the aforesaid set of claims or according to the said first aspect of the invention.

In a third aspect, the invention provides the use of a metal detergent system comprising a calcium salicylate and a magnesium salicylate, preferably as defined in one or more of the aforesaid claims or the said first aspect of the invention, to improve the cam and lifter wear in the crankcase lubrication of an internal combustion engine by a lubricating oil composition having a phosphorus concentration, expressed as atoms of the phosphorus, of not greater than 0.08 mass % based on the mass of the lubricating oil composition.

A lubricating oil composition according to the present invention may have a phosphorus content of at least 0.005, preferably at least 0.01 mass %, based on the mass of the oil composition.

A lubricating oil composition according to the present invention may have a total base number (TBN) of between 2 and 9, preferably between 4 and 8.

In this specification, the following words and expressions, if and when used, shall have the meanings ascribed below:

"active ingredient" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means in excess of 50 mass % of a composition;

"minor amount" means less than 50 mass % of a composition;

"TBN" means total base number as measured by ASTM D2896.

Furthermore in this specification:

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

The features of the invention relating, where appropriate, to each and all aspects of the invention, will now be described in more detail as follows:

Oil of Lubricating Viscosity A

This, sometimes referred to as the base oil or base stock, is the primary liquid constituent of the composition into which additives and possibly other oils are blended.

A base oil may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil and heavy duty diesel oil. Generally the viscosity of the oil ranges from 2 to 30, especially 5 to 20, $mm^2s^{-1}$ at 100° C.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly (1-hexenes), poly (1-octenes), poly (1-decenes)); alkylbenzenes (e.g. dodecylbenzenes, tetradecylbenzenes, dinonylbenzenes, di (2-ethylhexyl)benzenes); polyphenols (e.g. biphenyls, terphenyls, alkylated polyphenols); and alkylated diphenyl ethers and alkylated diphenyl sulfides and derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch-synthesised hydrocarbons made from synthesis gas containing hydrogen and carbon monoxide using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Base oil may be categorised in Groups 1 to V according to the API EOLCS 1509 definition.

The oil of lubricating viscosity is provided in a major amount, in combination with a minor amount of the additive (B) and, if necessary, one or more co-additives such as described hereinafter, constituting the composition. This preparation may be accomplished by adding the additive directly to the oil or by adding it in the form of a concentrate thereof to disperse or dissolve the additive. Additives may be added to the oil by any method known to those skilled in the art, either prior to, contemporaneously with, or subsequent to, addition of other additives.

The terms "oil-soluble" or "oil-dispersible", or cognate terms, used herein do not necessarily indicate that the compounds or additives are soluble, dissolvable, miscible, or are capable or being suspended in the oil in all proportions. They do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Metal Detergent System B

Metal detergents are additives that reduce formation of piston deposits in engines and that may have acid-neutralising properties, and the term 'detergent' is used herein to define a material capable of providing either or both of these functions within the lubricating oil composition. They are based on metal "soaps", that is metal salts of acidic organic compounds, sometimes referred to as surfactants, and that generally comprise a polar head with a long hydrophobic tail.

As stated, the metal detergent system comprises magnesium salicylate and calcium salicylate. Conveniently, each salicylate is alkyl-substituted for example with independent alkyl groups having from 8 to 30 carbon atoms and which may be linear, branched or cyclic. As examples of alkyl groups there may be mentioned the following: octyl, nonyl, decyl, dodecyl, pentadecyl, octadecyl, eicosyl, docosyl, tricosyl, hexacosyl, triacontyl, dimethylcyclohexyl, ethylcyclohexyl, methylcyclohexylmethyl and cyclohexylethyl.

Preferably, substantially all of the metal detergent system is the magnesium salicylate and the calcium salicylate in the sense that it contains, at most, minor or adventitious amounts of metal detergents other than the magnesium salicylate and the calcium salicylate. More preferred is a metal detergent system from which metal phenates and metal sulfonates are absent.

The mass ratio of magnesium to calcium atoms is greater than one, such as 5:4, 6:4, 8:5, 10:6 or greater. The mass ratio of magnesium atoms to calcium may be up to 5:2, 5:1, 7:1 and preferably up to 10:1.

Conveniently, the magnesium salicylate and the calcium salicylate provide from 50 to 4,000 preferably from 100 to 3,000, ppm by mass of atoms of magnesium and of calcium, based on the mass of the lubricating oil composition.

Other Additives

Other additives, such as the following, may also be present in the lubricating oil compositions of the present invention.

Ashless dispersants comprise an oil-soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersants may be, for example, selected from oil-soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and a polyalkylene polyamine.

Anti-wear agents may comprise dihydrocarbyl dithiophosphate metal salts wherein the metal may be an alkali or alkaline earth metal, or aluminum, lead, tin, molybdenum, manganese, nickel, copper, or preferably, zinc.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The preferred zinc dihydrocarbyl dithiophosphates (ZDDP) are oil-soluble salts of dihydrocarbyl dithiophosphoric acids and may be represented by the following formula:

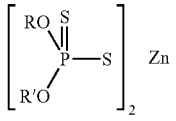

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

To limit the amount of phosphorus introduced into the lubricating oil composition by ZDDP to no more than 0.08 mass %, the ZDDP should preferably be added to the lubricating oil compositions in amounts no greater than from about 1.1 to 1.3 mass %, based upon the total mass of the lubricating oil composition.

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, aromatic amines, alkaline earth metal salts of alkylphenolthioesters having preferably $C_5$ to $C_{12}$ alkyl side chains, calcium nonylphenol sulfides, ashless oil soluble phenates and sulfurized phenates, phosphosulfurized or sulfurized hydrocarbons, phosphorus esters, metal thiocarbamates and oil-soluble copper compounds as described in U.S. Pat. No. 4,867,890.

Friction Modifiers which include boundary lubricant additives that lower friction coefficient and hence improve fuel economy may be used. Examples include ester-based organic friction modifiers such as partial fatty acid esters of polyhydric alcohols, for example, glycerol monooleate; and amine-based organic friction modifiers. Further examples are additives that deposit molybdenum disulphide such as organo-molybdenum compounds where the molybdenum is, for example, in dinuclear or trinuclear form.

Rust inhibitors selected from the group consisting of non-ionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in GB Patent Specification No. 1,560,830. Benzotriazoles derivatives also fall within this class of additives. When these compounds are included in the lubricating composition, they are preferably present in an amount not exceeding 0.2 mass % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880.

The final crankcase lubricating oil composition may employ from 2 to 20, preferably 4 to 18, and most preferably 5 to 17, mass % of the concentrate or additive package with the remainder being base stock. Preferably, it has a sulphated ash concentration of not greater than 1.0 mass % and/or a sulphur concentration, expressed as atoms of sulphur, of not greater than 0.3, preferably not greater than 0.2, mass %.

Engines

The invention is applicable to a range of internal combustion engines such as compression-ignited and spark-ignited two- or four-stroke reciprocating engines. Examples include engines for power-generation, locomotive and marine equipment and heavy duty on-highway trucks; heavy duty off-highway engines such as may be used for agriculture, construction and mining and engines for light duty commercial and passenger car applications.

EXAMPLES

The invention will now be particularly described in the following examples which are not intended to limit the scope of the claims hereof.

Two fully-formulated 5W40 lubricating oil compositions (or lubricants) were blended by methods known in the art. The two lubricants differed in that:

Lubricant 1, a lubricant of the invention, contained a metal detergent system consisting of magnesium salicylate, giving rise to 0.10 mass % of Mg atoms, and calcium salicylate, giving rise to 0.06 mass % of Ca atoms; and Lubricant A, a reference lubricant, contained a metal detergent system consisting of calcium salicylate, giving rise to 0.18 mass % of Ca atoms.

Each lubricant had a phosphorus content of 0.08 mass %, and a salicylate anion content of 17 mmol $l^{-1}$.

Each of the two lubricants was tested for cam and lifter wear according to the Sequence IIIG Test. The Test utilizes a 1996 General Motors 3800 cc Series II, water-cooled, 4 cycle, V-6 gasoline engine as the test apparatus. The Sequence III G test engine is an overhead valve design (OHV) and uses a single camshaft operating both intake and exhaust valves via pushrods and hydraulic valve lifters in a sliding-follower arrangement. Using unleaded gasoline, the engine runs a 10-minute initial oil-levelling procedure followed by a 15-minute slow ramp up to speed and load conditions. The engine then operates at 125 bhp, 3,600 rpm and 150° C. oil temperature for 100 hours, interrupted at 20-hour intervals for oil level checks.

At the end of the Test, the cam lobes and lifters were measured for wear. The results, expressed as average cam-plus-lifter wear in microns, were as follows, where the pass limit for the Test is a maximum of 60 microns.

Lubricant 1: 57

Lubricant A: 81

The results demonstrate that the use of a combination of magnesium salicylate and calcium salicylate in Lubricant 1 gave better wear performance in an accredited engine test than use of calcium salicylate alone in Lubricant A, to the extent that Lubricant 1 passed the Test whereas Lubricant A failed.

What is claimed is:

1. An internal combustion engine crankcase lubricating oil composition having a phosphorus concentration, expressed as atoms of phosphorus, of from about 0.01 to not greater than 0.08 mass %, based on the mass of the oil composition, which composition comprises or is made by admixing:

A. an oil of lubricating viscosity, in an amount of at least 80% by weight based on the total weight of the composition; and B. a metal detergent system, in an amount providing from 1,600 to 3,000 ppm by mass of atoms of calcium and of magnesium, based on mass of the oil composition, consisting essentially of a calcium salicylate and magnesium salicylate and having a mass ratio of magnesium atoms to calcium atoms of from 10:6 to 5:1.

2. An oil composition as claimed in claim 1, having a sulphated ash concentration of not greater than 1.0 mass %.

3. An oil composition as claimed in claim 1, having a sulphur concentration, expressed as atoms of sulphur, of not greater than 0.3 mass %.

4. An oil composition as claimed in claim 1, comprising one or more additives, other than calcium salicylate and magnesium salicylate, selected from dispersants, detergents, antioxidants, antiwear agents, friction modifiers, corrosion inhibitors, pour point depressants, demulsifiers and antifoaming agents.

5. A method of improving the cam and lifter wear in the crankcase of an internal combustion engine which comprises the step of lubricating said internal combustion engine with a lubricating oil composition as claimed in claim 1.

* * * * *